US005344356A

United States Patent [19]

Pizzelli et al.

[11] Patent Number: 5,344,356

[45] Date of Patent: Sep. 6, 1994

[54] DECORATIVE TOY AND STORAGE UNIT WITH ATTACHABLE HOLDERS

[76] Inventors: David A. Pizzelli, 81A Washington St., Franklin, Mass. 02038; Paul W. Groome, 413 Beacon Ave., Woonsocket, R.I. 02895; Charles E. Pizzelli, 37 Forest St., Franklin, Mass. 02038

[21] Appl. No.: 38,852

[22] Filed: Mar. 29, 1993

[51] Int. Cl.[5] ..... A63H 3/00

[52] U.S. Cl. ..... 446/73; 446/901; 428/100; 428/18

[58] Field of Search ..... 446/73, 72, 100, 901, 446/268; 428/18, 100

[56] References Cited

U.S. PATENT DOCUMENTS

| | | | |
|---|---|---|---|
| 3,128,514 | 4/1964 | Parker et al. | 446/901 X |
| 3,525,376 | 8/1970 | Muhlhauser | 428/100 X |
| 4,452,362 | 6/1984 | Mancin | 428/100 X |
| 4,543,278 | 9/1985 | Ackerman | 428/18 |
| 4,671,514 | 6/1987 | Wilson-Diehl | 446/901 X |
| 4,749,604 | 6/1988 | Foster | 428/100 |
| 4,902,261 | 2/1990 | Pratt et al. | 446/73 X |
| 4,950,194 | 8/1990 | Gullace | 446/72 |
| 5,118,318 | 6/1992 | Lorizio | 446/72 |

*Primary Examiner*—Mickey Yu

*Attorney, Agent, or Firm*—Edwin H. Paul; Jerry Cohen

[57] ABSTRACT

A toy (2) with Velcro TM covering the visible surface, and holders (10, 18) also with Velcro TM areas. The holders are arranged as receptacles for small items, such as hair bows, combs and barrettes, and the holders may be attached to the toy in decorative, playful and creative ways providing a combination toy and decorative storage facility. The toy is preferably a stuffed animal.

3 Claims, 5 Drawing Sheets

DECORATIVE TOY AND STORAGE UNIT WITH ATTACHABLE HOLDERS

FIELD OF THE INVENTION

The present invention relates generally to toys that also provide a decorative storage apparatus for personal and other sundry items. In particular, toys which serve the purposes of a playtoy in itself, while providing means for the user to create different effects by the attachment of holders, each containing a hair clip (or pair of hair clips), bow, comb, curler and any other of such items, onto the toy itself. The toy with attached viewable holders and items provides a decorative storage place for such items.

BACKGROUND OF THE INVENTION

Personal items like hair clips, combs and pins, especially children's, are often just left where they were in a very disorganized and messy manner when interest ended—leaving the parents to restore order. Such items are easily lost, damaged or misplaced when left lying about, especially when the item is one of a pair—like matched hair bows. In addition if such items are haphazardly stored in drawers or closets they may be lost and/or damaged, and, even when properly stored, such items are hidden where they may be forgotten. It is an object of this invention to overcome these problems.

An earlier attempt, addressing the storage problem, is found in U.S. Pat. No. 4,654,991 to Leila H. Jones, this patent discloses a hanger for toys or other objects. The hanger visually displays toys, dolls and/or other such items via Velcro straps. The Jones patent does not provide that the hanger itself is a toy or plaything, and the attachment of the toys to the hanger is not playing with the combination toy and hanger. In addition the attachment is not creative and provides no incentive for the children to be neat and put away such items.

U.S. Pat. No. 4,729,751 to Cynthia G. Schiavo et al. discloses a doll with attachment means. This invention is a toy doll with Velcro attachments whereby the hands can be joined, or lollipops attached to the hands. Schiavo et al. provide an extended way of playing with the doll by, in effect, providing for a kit of doll accessories which can be attached as part of the play. However, there is no suggestion or means provided or suggested to allow other items not associated in some way with the doll to be attached, nor is there any suggestion of using the doll for storage of the attached items.

It is an object of the invention to provide a means for users to store personal and other sundry items in a decorative manner onto a toy, where the act of storing the item is a creative and fun part of playing with the toy. It is an object of this invention, that when interest has waned in the toy, to provide a viewable and decorative storage facility—the combination toy and attached items.

It is another object of the present invention to provide a simple attachment means such that even small children can attach items to the toy.

It is another object of this invention to provide a means for visual, decorative storage of personal and other items in a manner such that the user has full view of the items themselves—so such items are not forgotten.

Another object of this invention is to provide a toy useful in itself, but also to provide a means for the user to creatively use and arrange attachable items.

It is another object of this invention to provide an incentive for children to put things away by making the task playful and instructive. In this way the child is encouraged to be neat and responsible.

SUMMARY OF THE INVENTION

The foregoing objects are met in a new toy with areas (over the entire object or only small areas of the object) of attachment means, and where holders with matching attachment means may be placed. The holders may be arranged to hold hair clips, combs or other sundry items. The effect is a toy with extended play capability of attaching items to the toy itself thereby creating other effects, while also providing a decorative display and storage facility for such items. Herein toy is defined as: any plaything, game or device which may be a one (dominated by a single dimension as in a ribbon or banner), two or three dimensional decorative or scenic object, for example, a stuffed animal or doll or other figure, a decorative doll pillow, a decorative or scenic mat, wall hanging, strap or rope. In a preferred embodiment the toy is a plush stuffed animal figure wherein the attachment means comprises an attachment fabric of soft nylon (or other such material) closure compatible fabric. Herein after nylon closure material is defined as any soft or not soft fabric or combination of fabrics or materials or plastic-like materials or hooks and loops or Velcro TM -like materials useful for attachment purposes.

The toy has patches or areas with attachable means, soft nylon closure material in a preferred embodiment, but alternative attachment means may be used to advantage. A holder, suitable as a receptacle for personal or other small items, such as a hair clips, bows, combs, earrings, barrettes, rings or other jewelry, or extra holders has areas with attachable means wherein the holder with an item contained or not may be attached to the toy itself. The act of attaching the item, deciding which item goes where, and selecting the colors involved all provide an extended play use of the toy and holders. The effect is to creatively make one toy into several while, simultaneously, providing a decorative storage facility for the toy, the holders attached and the contents of the holders.

The holders in a preferred embodiment are elastic nylon sheaths which enclose or clasp the item such that the item is viewable. A soft nylon closure patch is sewn onto the holder for attachment to the toy. Other holder preferred embodiments include: straps which may go through a ring or around an item; and hard enclosures or soft sacks which completely enclose the item. The holders may be transparent or opaque and be of various colors.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1A:
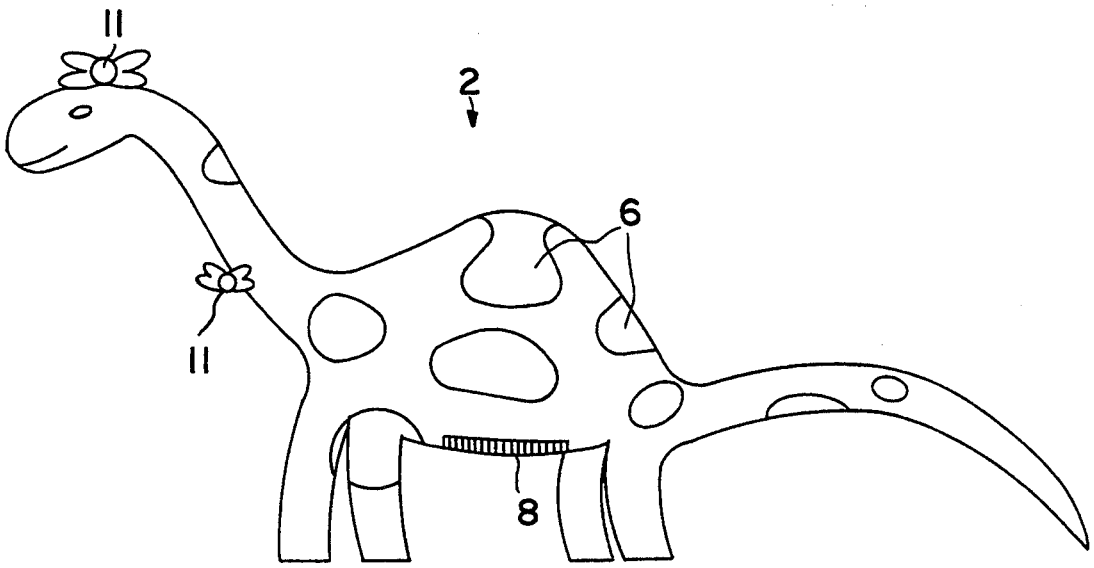
FIGS. 1A and 1B are pictorials of stuffed animal figures of dinosaurs in accordance with the present invention.
Figure 1B:
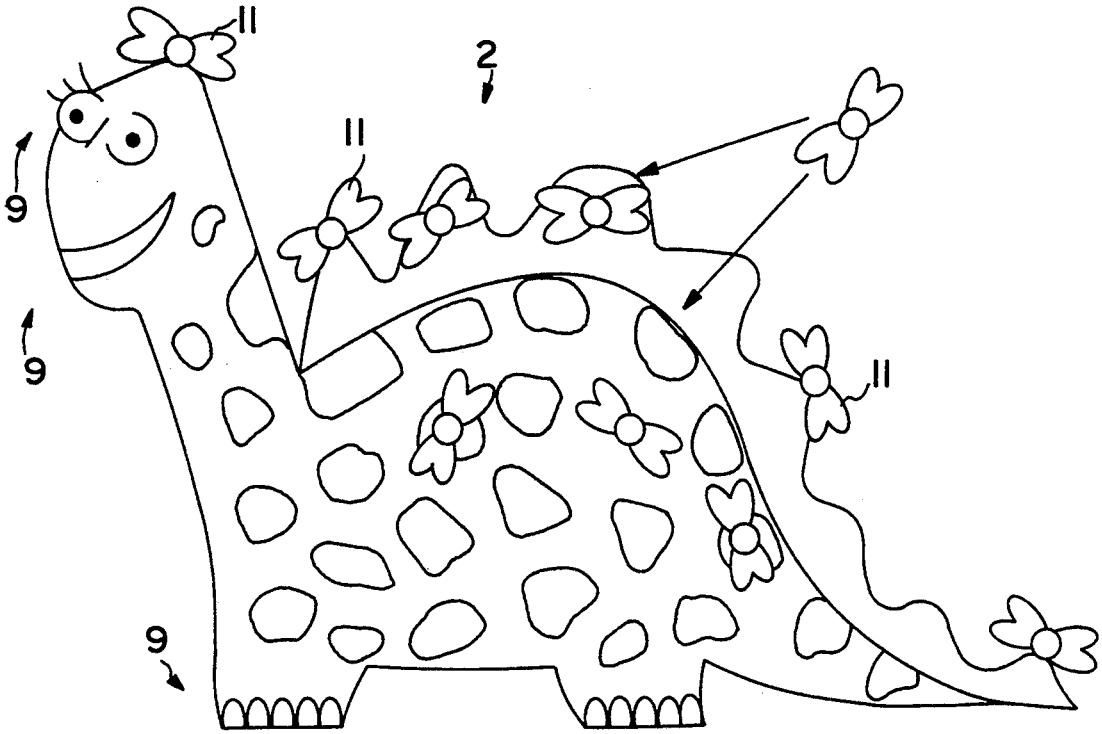
Figure 3D:
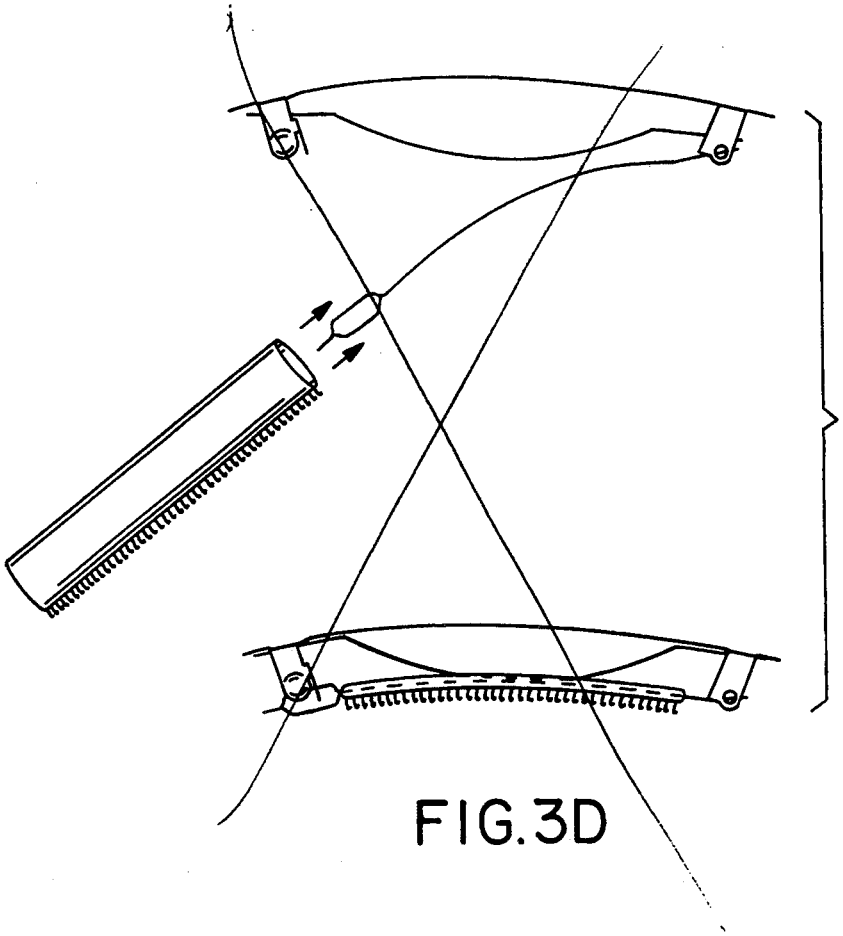

FIG. 1A shows a plush stuffed animal 2 toy shaped to resemble a dinosaur. The animal has patches 6 distributed over its body, each patch forming an attachment area on the animal. A hair bow is attached to the toy via a holder (see below). In another preferred embodiment the entire surface of the animal may be an attachment surface. Nylon closure material of soft hooks or loops or combinations thereof comprise the attachment areas. The underside of the stuffed animal has a zipper 8 which is an access area allowing storage within the animal. In this preferred embodiment an internal storage pocket is provided for personal items of the owner, other toys and the holder accessories, described below. FIG. 1B is a depiction of a dinosaur stuffed toy with plastic molded eyes, mouth and toe nails 9.

Figure 2:
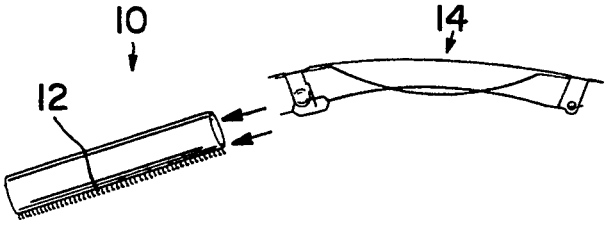
FIG. 2 is a pictorial of a holder.

FIG. 2 shows a cloth (nylon preferred) sheath receptacle 10 with a nylon closure material attachment area 12. A hair bow 14 may be inserted into the sheath 10. The sheath with bow may then be attached via the nylon closure to the stuffed animal 11 as shown on FIG. 1. One effect is to position a child's hair bow onto the stuffed animal to create a bow tie effect 11 on top of the toy's head 11 shown in FIG. 1A. Many different creative effects may be made with combinations of personnel items in holders attached to different positions on the animal.

Figure 3A:
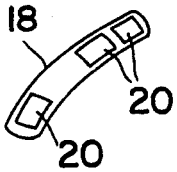
FIG. 3A is a pictorial of an alternate holder.
Figure 3B:
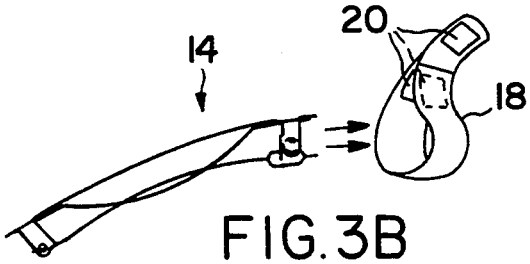
FIG. 3B diagrams the interaction of a hair clip and the holder of FIG. 3A.
Figure 3C:
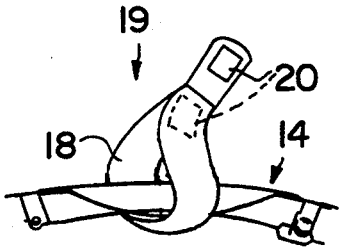
FIG. 3C is a pictorial of the holder and hair clip together.

FIG. 3A details another type of preferred holder. Here a strap 18 with nylon closure areas 20 may be looped around a hair bow 14. The bow is secured by the nylon closure areas of the strap, as shown in FIG. 3B and FIG. 3C. One nylon closure area 20 is available for use in attaching the hair bow to the stuffed animal.

Other preferred embodiments of the holder include elastic bands, bags made of supple material, hard body receptacles, and the like.

Other preferred embodiments for the attachment means included, snaps, ties, pins, buttons, eyelets and laces, magnets or magnet material and the like.

Figure 4:
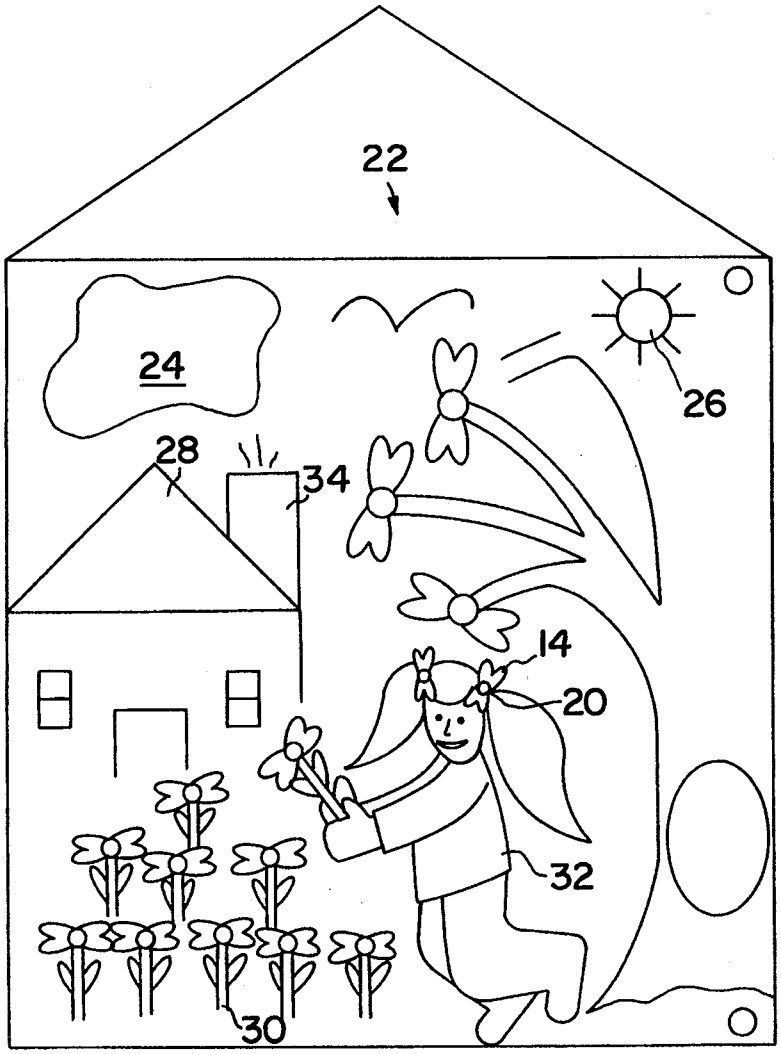
FIG. 4 is a pictorial showing a user attaching a holder with hair clip to a flat mat with a scene.

FIG. 4 shows a toy mat or wall hanging 22 with a scene. The scene has attachment areas forming part of the scene: a house 28, plants 30, and girl 32, a cloud 24, a sun 26 and a smoke stack 34. The owner of the mat (presumably, not necessarily, a child) may place a hair bow 14 retained in a holder strap 18 in to any location in the scene, for example on the head of the girl 32 to give the effect that the girl in the scene is wearing the owners actual hair bow.

Figure 5:
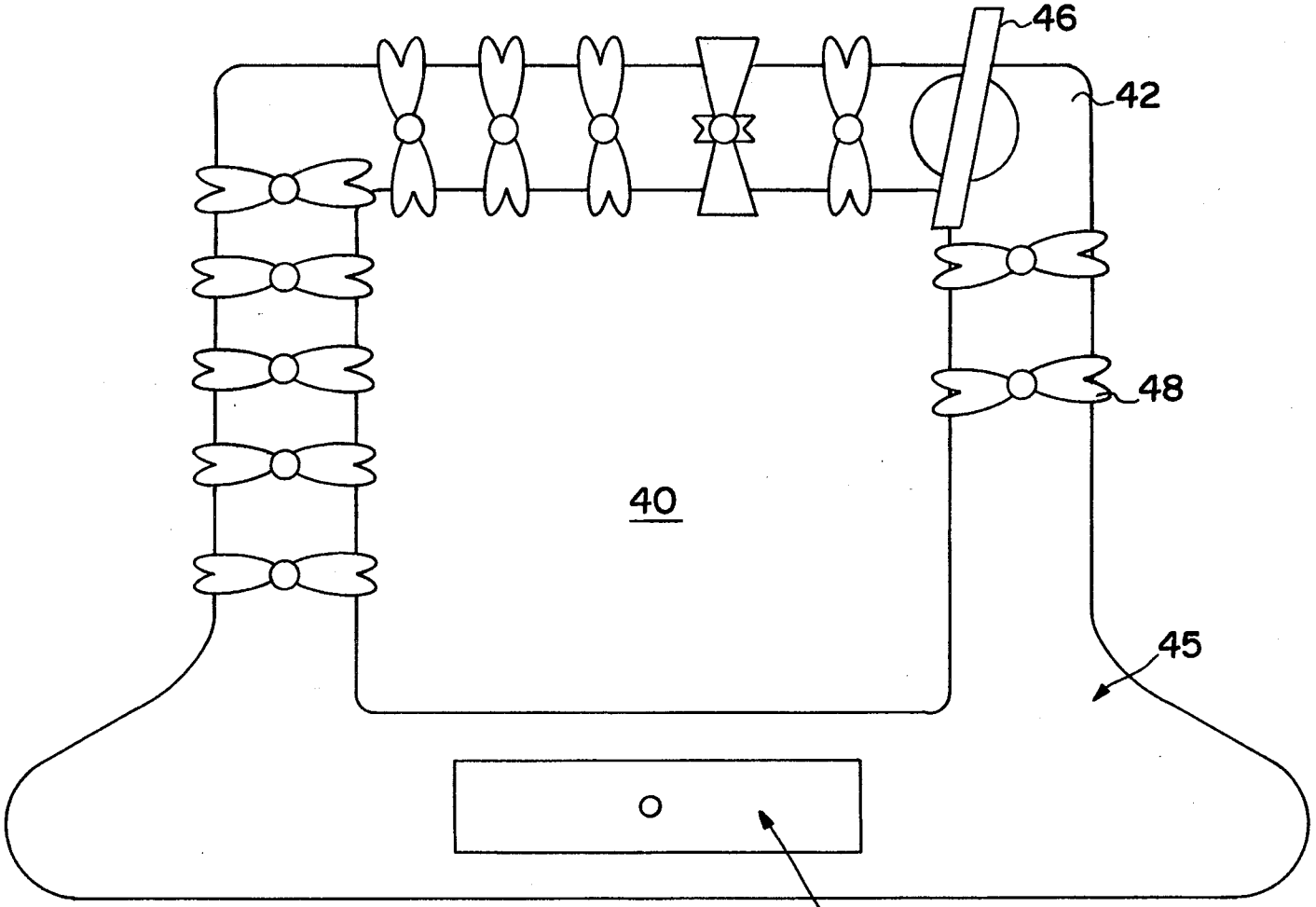
FIG. 5 is a pictorial of a mirror with a decorative frame in accordance with the present invention.

FIG. 5 shows a mirror with a decorative frame 42 with nylon closure material covering part or all of the frame. Holders with items may be attached, e.g. a comb 46 and a bow 48. The mirror is provided with a drawer 43 and base 45 that allows flexibility in placing the mirror, alternatively the mirror may be hung from a wall.

Figure 6:
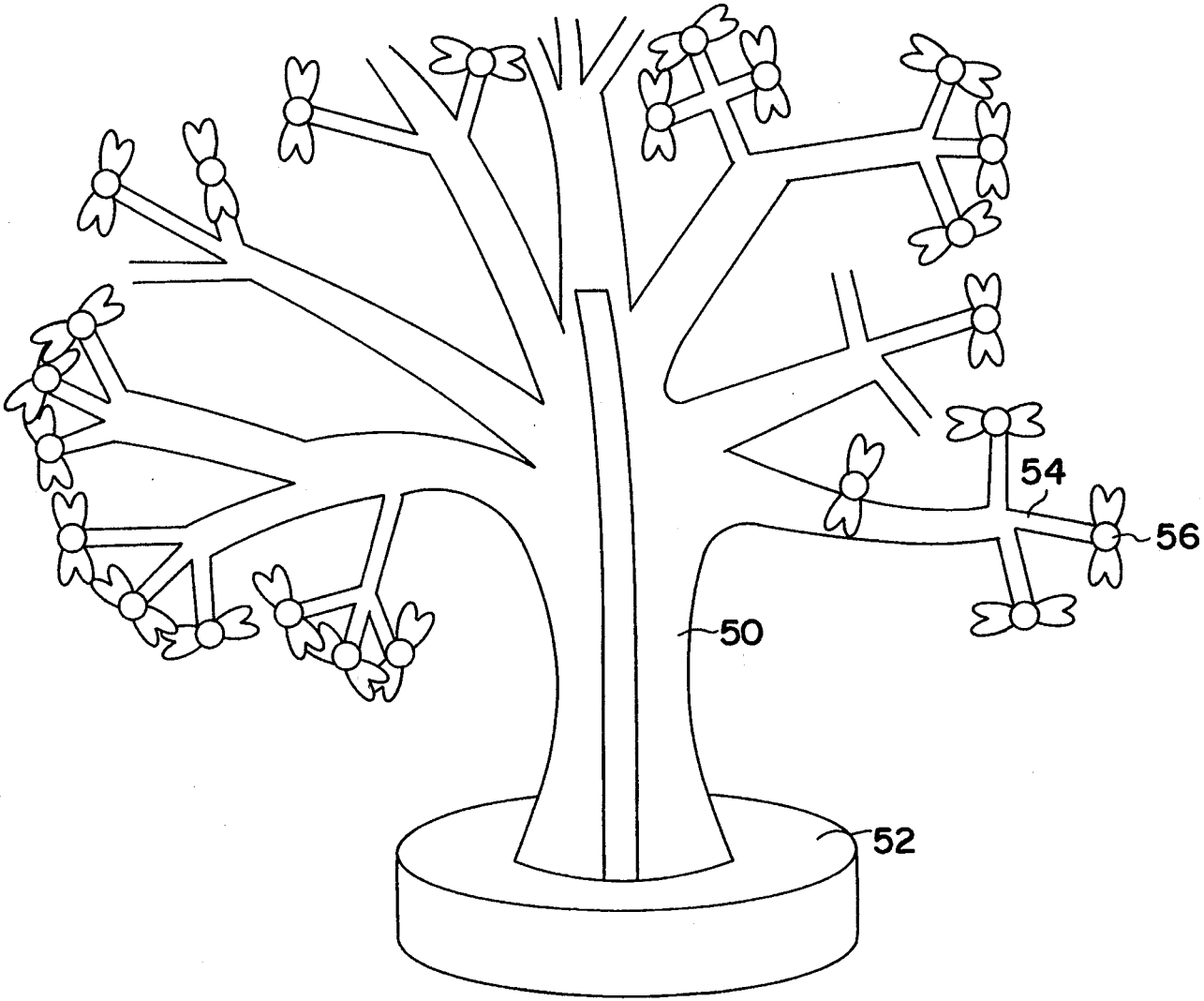
FIG. 6 is a pictorial of the present invention as a decorative storage tree.

FIG. 6 is an artificial tree 50 with a weighted base 52. The tree branches 54 and/or leaves are made of nylon closure material. The owner may attach a holder with hair bows 56 to the nylon closure material to create different decorative effects.

Figure 7:
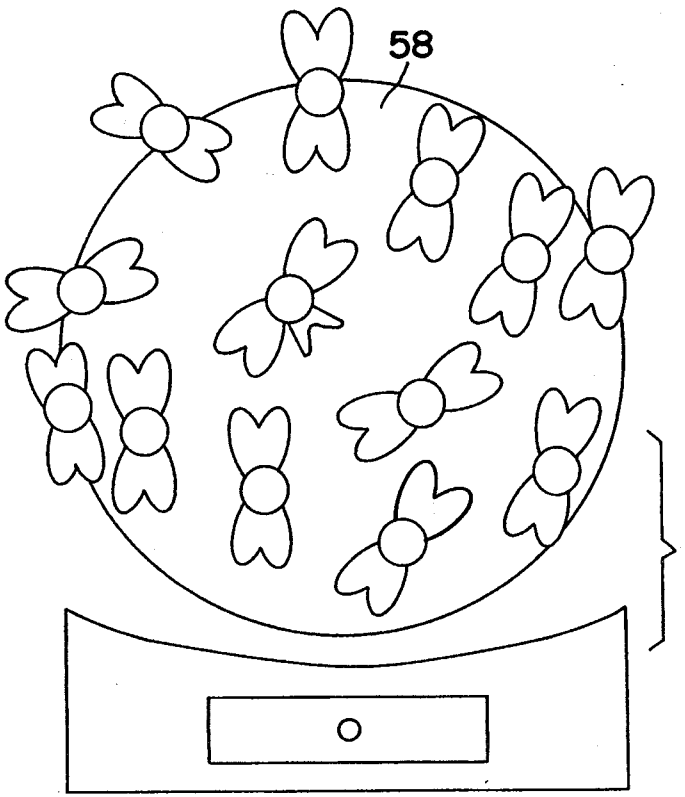
FIG. 7 is a pictorial of a ball or globe in accordance with the present invention.

Another preferred embodiment is a globe or ball 58 as in FIG. 7. Here again, the entire globe is entirely covered with nylon closure material. Other preferred embodiments may cover a portion of the globe. Here also, the owner may attach a holder with hair bows 58 to the nylon closure material to created different decorative effects.

Other preferred embodiments of the toy include other one, two or three dimensional toys. For the purposes of this invention a one dimensional toy is herein defined as a figure having a surface but the figure is dominated by a single dimension (length), e.g. a rope, banner, ribbon, or pole. A two dimensional toy is herein defined as a figure having a surface but the figure is dominated by two dimensions (area), e.g. a mat, picture or wall hanging, and a three dimensional toy is herein defined as a figure having a surface but the figure is dominated by three dimensions (volume), e.g. a stuffed animal, ball.

An important aspect of the present invention, in addition to the creative toy, is that the combination of personal holders with items are placed on the toys forming a permanent, decorative storage place for the items where the items can be easily viewed. All the attached items are visible for making choices and any loss of one item from a pair (like earrings) will be immediately noticed. This will provide a good chance for recovery of the lost item.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A toy comprising:

(a) a three dimensional character figure having a surface, said three dimensional figure constructed and arranged as a plaything, (b) first attachment means distributed over and covering substantially the entirety of said surface, (c) personal items, (d) a plurality of holder means arranged and constructed as a receptacle for said personal items, wherein said held items are visible, and (e) second attachment means, matingly corresponding with said first attachment means, constructed on said holder means for attaching said holder means, containing said personal items or not, to said surface.

2. A toy as defined in claim 1 wherein said personal items are hairbows, hairclips and barrettes, and said three dimensional figure is a stuffed animal.

3. A toy comprising:

(a) a stuffed character figure having a surface, (b) first decorative areas of nylon closure material distributed over said figure, the surface coverage of said first decorative areas running from complete to very little, personal items, (c) a plurality of holders means arranged and constructed as a receptacle for personal items, wherein said items are held visible, (d) second nylon closure material constructed on said holder means, wherein said first and second nylon closure material are arranged for attaching to each other, (e) means for accessing inside said stuffed figure for storing unused holder means and personal items therein, and (f) wherein said holder means, containing said items or not, may be attached to said figure, and wherein said attaching is creative and playful, and wherein the combination of said figure and holders form a decorative storage means for said items.

* * * * *